United States Patent [19]

Davis

[11] Patent Number: 4,736,807

[45] Date of Patent: Apr. 12, 1988

[54] APPARATUS FOR ROTATING AND RECIPROCATING WELL PIPE

[75] Inventor: Kevin D. Davis, Tomball, Tex.

[73] Assignee: Exxon Production Research Company, Houston, Tex.

[21] Appl. No.: 882,879

[22] Filed: Jul. 7, 1986

[51] Int. Cl.[4] ..... E21B 3/00

[52] U.S. Cl. ..... 173/164

[58] Field of Search ..... 173/164, 165; 175/195, 175/103

[56] References Cited

U.S. PATENT DOCUMENTS

| | | | |
|---|---|---|---|
| 1,339,955 | 5/1920 | Hardel . | |
| 1,928,947 | 10/1933 | Newman | 173/165 X |
| 1,983,545 | 12/1934 | Johnson | 173/165 |
| 2,609,881 | 9/1952 | Warren . | |
| 2,675,082 | 4/1954 | Hall . | |
| 2,784,942 | 3/1957 | Peck et al. | 175/195 |
| 3,363,688 | 1/1968 | Bielstein . | |
| 3,570,610 | 3/1971 | Kehrberger | 173/165 |
| 4,258,802 | 3/1981 | Tullos et al. | 175/103 |
| 4,317,493 | 3/1982 | Thompson . | |

OTHER PUBLICATIONS

B. Mills, "Rotating While Cementing Proves Economical," The Oil Weekly, Dec. 1939, pp. 14 and 15.

*Primary Examiner*—E. R. Kazenske
*Assistant Examiner*—Willmon Fridie, Jr.
*Attorney, Agent, or Firm*—John S. Schneider; Alfred A. Equitz

[57] ABSTRACT

Apparatus for simultaneously rotating and reciprocating well pipe mechanically utilizing the rotary table on the drilling rig includes a rotating pipe clamp assembly having an irregular cross-sectional mid-member and clamp members for releasably gripping the well pipe connected to the ends of the mid-member for rotation therewith; a square block for fitting the rotary table square and having a selected groove configuration; and a torque transmitting means fitting into the groove and having openings there-through having the same irregular cross-section as said mid-member cross-section. Means connects the torque transmitting means and the block for limiting torque applied to the well pipe via the clamp assembly and the torque transmitting means.

5 Claims, 4 Drawing Sheets

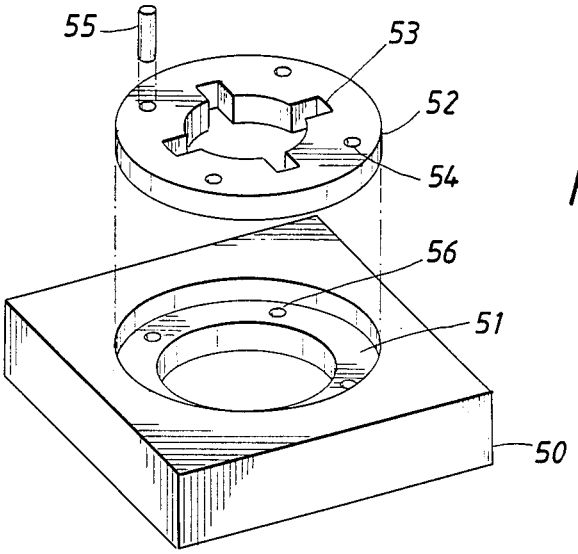
FIG. 7
FIG. 8
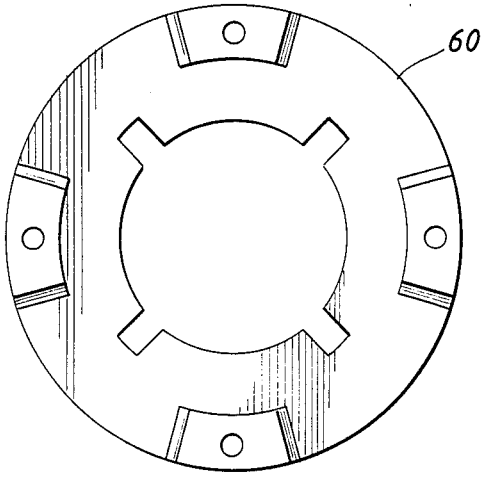
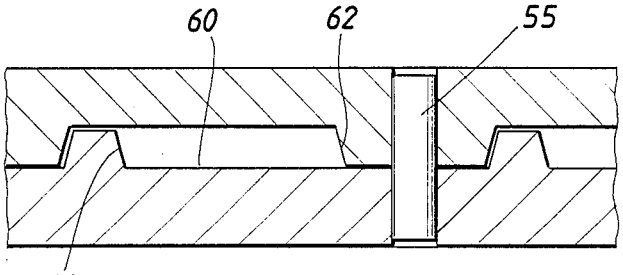
FIG. 9
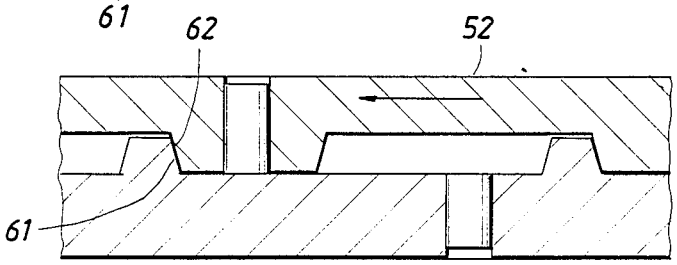
FIG. 10

APPARATUS FOR ROTATING AND RECIPROCATING WELL PIPE

BACKGROUND OF THE INVENTION

1. Field of the Invention

The present invention concerns simultaneous rotation and reciprocation of well pipe and, more particularly, clamp-on apparatus for mechanically rotating and reciprocating well pipe during cementing operations.

2. Background Information

The simultaneous rotation and reciprocation of well pipe while cementing improves the quality of the cement job. At present, only hydraulic power swivels allow simultaneous rotation and reciprocation of well pipe. These hydraulic swivels stop rotation when a maximum torque limit is reached. They work well but are expensive and require an operator and an external power source, usually truck mounted, for their use. The present invention permits simultaneous rotation and reciprocation of well pipe using only rig power; pipe rotation stops automatically when a maximum torque limit is reached; and the apparatus is independent of the type of rig with which it is used and is easy to rig up and operate.

SUMMARY OF THE INVENTION

In accordance with the present invention the apparatus for simultaneously rotating and reciprocating well pipe mechanically utilizing the rotary table of a drilling rig comprises a rotating type clamp assembly having a mid-member with an irregular cross-section and clamp members for releasably gripping the well pipe connected to the ends of the mid-member for rotation with that member. A square block, for fitting into the rotary table square, has a selected grooved interior configuration. A torque transmitting means fits into the grooved interior and has grooves through it having the same irregular cross-section as the cross-section of the mid-member. Means are provided to connect the torque transmitting means and the block for limiting torque applied to the well pipe by the clamp assembly and the torque transmitting means.

Each clamp member comprises a body member having one end matingly engaging the irrgularities of the cross-section of the mid-member and a lock nut threaded to the body member at each end thereof, a sleeve grip member surrounded by the body member and engageable with the well pipe, and a lock ring located between the lock nut and the sleeve grip within the body member. The torque limiting means is preferably a wheel having grooves, frictional hold means on the block, and shear pins releasably holding the wheel and block in position for rotation together.

BRIEF DESCRIPTION OF THE DRAWINGS

FIG. 7 is a oblique view illustrating an embodiment of the torque limiting means;

FIG. 8 is a schematic top view of the block and wheel arrangement; and

FIGS. 9 and 10 illustrate the block and wheel arrangement before and after, respectively, shearing of the torque limiting shear pin.

DESCRIPTION OF PREFERRED EMBODIMENTS

Figure 1:
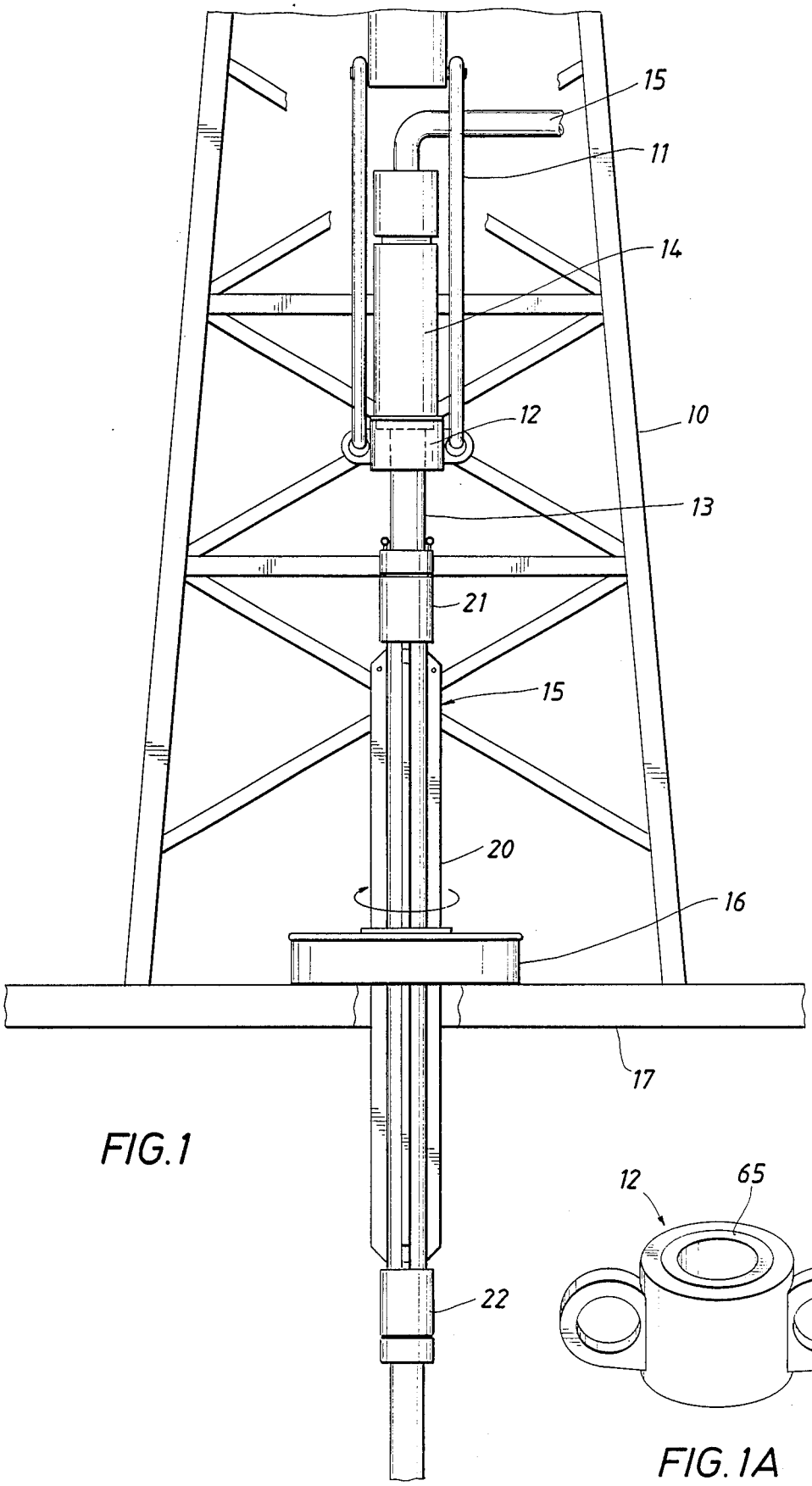
FIG. 1 is a schematic view of an embodiment of the invention arranged on a drilling rig.
Figure 1A:
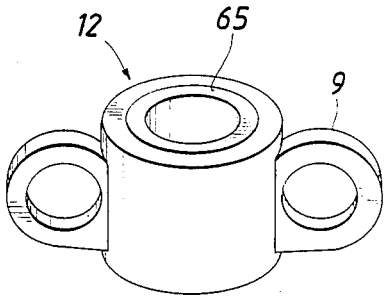
FIG. 1A is an oblique view of the elevator shown in FIG. 1.

Referring to FIGS. 1 and 1A, there is shown a drilling rig derrick 10, having a block and tackle (not shown) supported from the crown of derrick 10 from which bails 11 are hung. Bails 11 engage lugs 9 of a rotating elevator 12 to support the elevator and casing or other well pipe 13. A conventional rotating cement head 14 to which a cementing pipe 19 is connected at its upper end is positioned above rotating elevator 12. A rotary type clamp assembly 15 is clamped to well pipe 13 and extends through rotary table 16 mounted on rig floor 17 along with well pipe 13. Clamp assembly 15 includes an elongated splined or mid-member 20, and an upper quick release clamp member 21 and a lower quick release clamp member 22.

Figure 2:
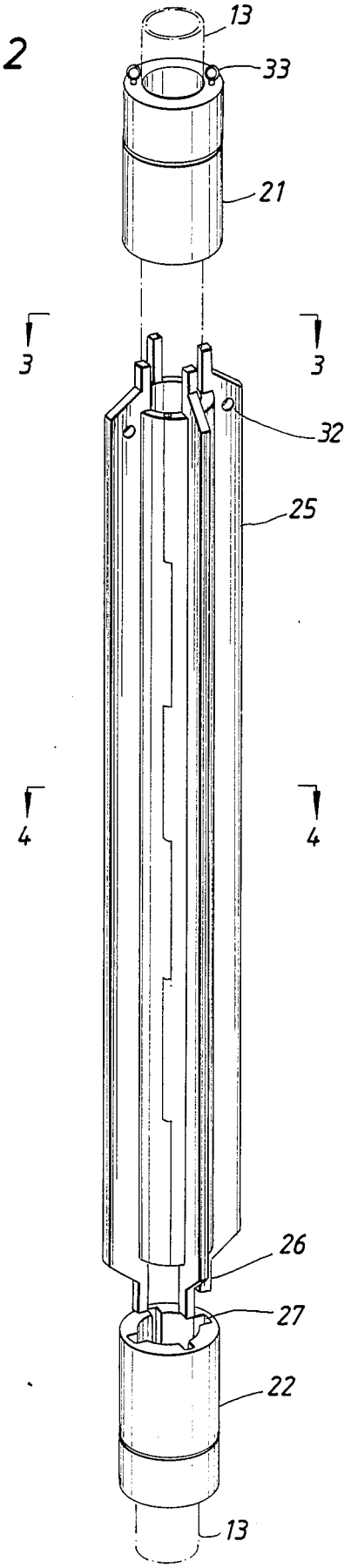
FIG. 2 is an oblique view of the clamp assembly portion of the invention.
Figure 3:
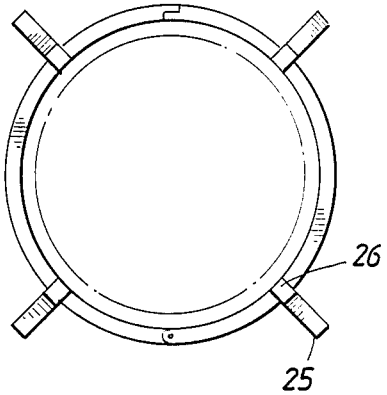
FIG. 3 is a view taken along lines 3—3 of FIG. 2.
Figure 4:
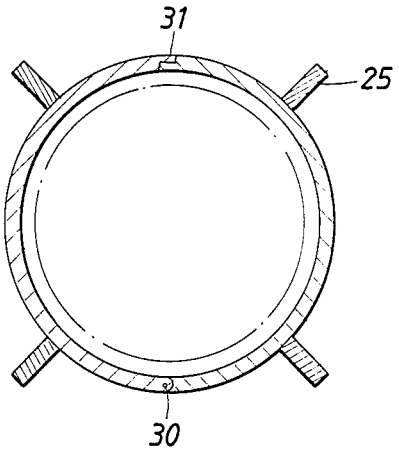
FIG. 4 is a view taken along lines 4—4 of FIG. 2.

Details of the clamp assembly are illustrated in FIGS. 2 through 4. Splined member 20 has four splines 25 that terminate at the upper and lower ends in narrowed portions 26 that engage and fit interior grooves 27 in the quick release clamps 21 and 22. As illustrated in FIGS. 3 and 4, splined member 20 may be hinged as at 30 and releasably connected at 31. Lifting eyes 32 and 33 are provided on the upper ends of two of the splines 25 and on clamp 21, respectively, as shown.

Figure 5:
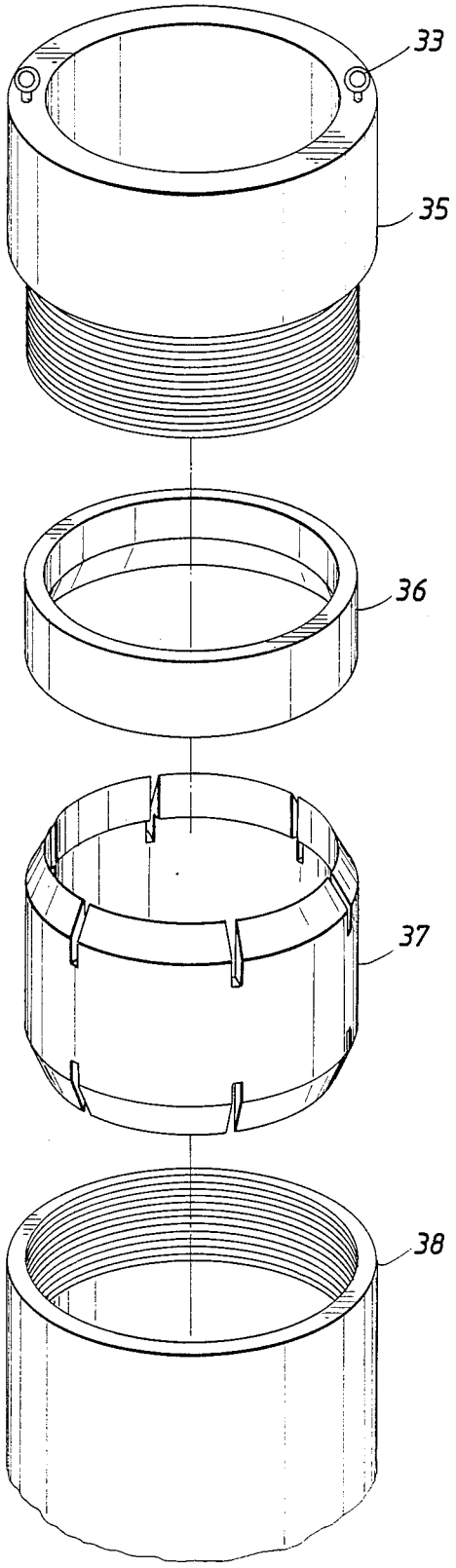
FIG. 5 is an oblique view of the parts of the quick release clamp.
Figure 6:
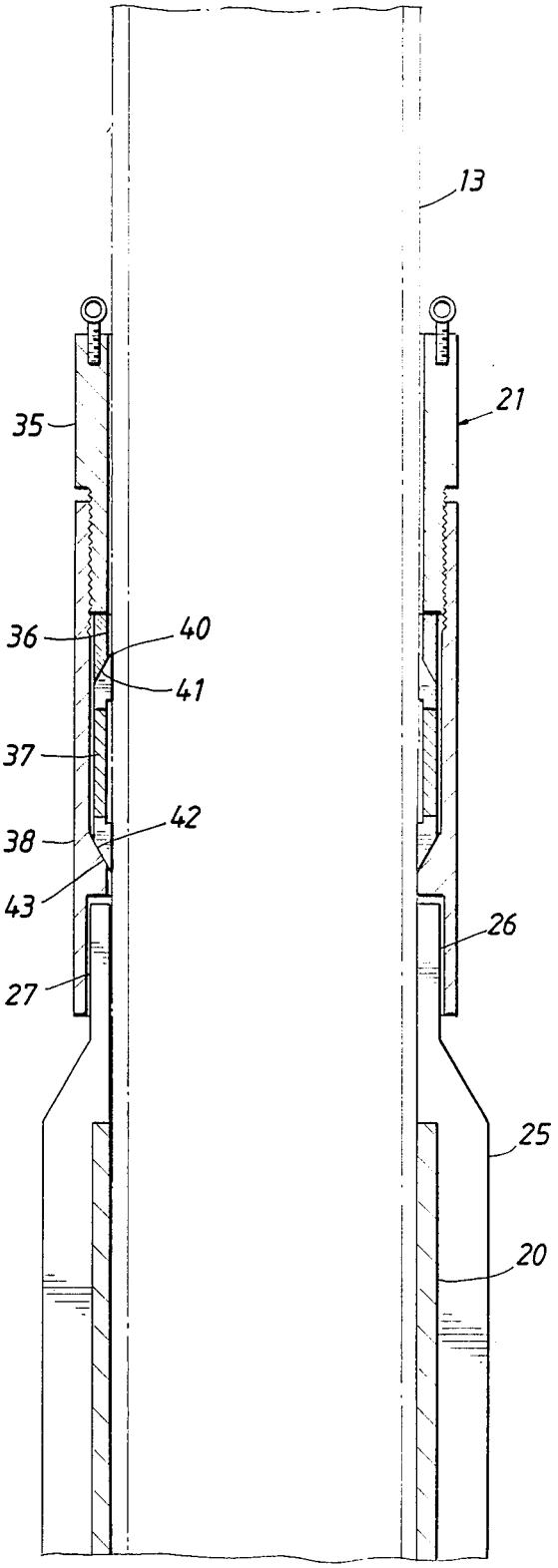
FIG. 6 is a schematic view showing the clamp mounted on one end of a splined section surrounding a well pipe.

One type of quick release clamp 21 or 22 is shown in detail in FIGS. 5 and 6. The clamp has four components: a lock nut 35, a lock ring 36, a sleeve grip member 37 and a body member 38. Grooves 27 in body member 38 are engaged by the end portions 26 of splines 25 and permit easy insertion and removal of splined member 20. Lock nut 35 is threaded to the upper end of body member 38. Sleeve grip 37 is urged into gripping contact with pipe 13 by lock ring 36 which has a lower tapered surface 40 engaging an upper tapered surface 41 of sleeve grip member 37 and a lowered tapered surface 42 of sleeve grip member 37 engaing a lower tapered inner shoulder 43 on body member 38. Lower quick release clamp 22 clamps to pipe 13 in a similar manner.

Referring now to FIGS. 7 through 10, one configuration for transferring torque from the rig rotary table 16 to the rotational clamp assembly 15 is illustrated. In this example, a square block 50 fits into the rotary table square of rotary table 16 in place of the master bushing. Block 50 could also have pins for use on pin-drive master bushings. Block 50 has a circular recessed portion 51 into which a wheel member 52 fits. Wheel member 52 has grooves 53 therethrough for engaging splines 25 and openings or holes 54 through which shear pins 55 are inserted. Shear pins 55 engage holes or openings 56 in the recess in block 50 to releasably lock wheel member 52 and block 54 together.

If clamp assembly 15 had a shape or configuration other than the four splines, wheel 52 would have a mating shape. For example, a square shape if the clamp assembly cross-section were square. This connection transfers torque while permitting reciprocation. Shear pins, a clutch mechanism, or other limiting devices fix the wheel to the block and shear or slide at a fixed torque. Varying the number of shear pins or adjusting the clutch varies the maximum torque limit.

The rotary table block 50 must not lit pipe 13 recoil completely in the counter-clockwise direction in the event the maximum allowable torque is exceeded. FIGS. 8 through 10 show one way to prevent such recoil if shear pins are used. The sliding surface between block 50 and wheel 52 is radially grooved as indicated at 60. During normal operation, the shear pins 55 transfer the torque. If shear pins 55 are sheared, wheel 52 rotates counter-clockwise relative to block 50 until the tapered shoulders 61 and 62 contact each other. If the remaining torque exceeds the frictional hold of tapered shoulders 61 and 62, wheel 52 will ride up the taper on shoulder 61 of block 50 and shoulder 62 on wheel 52, and cross over into the next groove 60 and rotate counter-clockwise until shoulder 62 contacts the next shoulder 61. This process continues until the recoil torque cannot overcome the frictional hold of the tapered shoulders 61 and 62, and recoil rotation stops. This problem of recoil is inherently solved when a clutch-type mechanism is used.

Rotating elevator 12 supports pipe string 13 and provides a means for reciprocation. The rotating elevator is similar to regular elevators but is not hinged in the middle. In the example shown, (FIG. 1A), elevator 12 slides over well pipe 13 before cement head 14 is attached. A thrust bearing 65 allows well pipe 13 and cement head 14 to rotate while elevator 12 remains stationary and supports the casing string. A rotating cement head, such as those offered by cement companies, must be used for this operation (see e.g. the casing swivel on page 3862 of the World Oil Catalog, published by Gulf Publising Company, 1982 Edition). Such cement heads are not currently designed to support well pipe weights, thus the need for the rotating elevator. If a rotating cement head is designed to support well pipe and still maintain a pressure seal, a rotating elevator would be unnecessary.

The system is simple and inexpensive. Well pipe 13 is rotated by the rig rotary table 16 and reciprocated by the rig traveling block. Shear pins, a clutch mechanism, or other limiting devices stop rotation automatically when a maximum torque is reached. The system can be used on any rotary type rig and it can be moved from rig to rig.

The clamps securely grip the well pipe to transmit the necessary torque without gouging the well pipe surface. The clamp distributes the forces evenly around the well pipe circumference so as not to collapse the well pipe wall. The clamp operates easily using standard rig equipment. The rig tongs grip the clamp body and lock nut to tighten the clamp onto the well pipe. The rotating clamp assembly simply transforms the last joint of well pipe into a kelly, but since it clamps onto the last joint of well pipe, the well pipe can be run as usual without concern where the last connection ends up in the pipe string. If a kelly was used, the well pipie would have to be spaced out correctly on each job.

Operation is no more complicated than with a power swivel. Rig-up time is less. A special operator is unnecessary, and no support trucks are needed. The clamp-on system differs from existing power swivels in several ways:

1. The power swivel works by hydraulics. An hydraulic motor rotates the well pipe. The clamp-on system of the present invention rotates the well pipe mechanically, utilizing the drilling rig's rotary table.

2. Since the power swivel is hydraulic, it requires an external power source and fluid reservoir. The clamp-on system of the invention requires no external equipment.

3. The power swivel limits torque by regulating fluid pressure. Shear pins or a clutch mechanism limits torque on the clampon system of the invention.

4. The power swivel is a pressure vessel in itself. Fluids circulate through the bore of the power swivel. A pressure seal must be maintained with the well pipe and also with operating valves on the power swivel body. That is in addition to the hydraulic power system. No part of the clamp-on system of the invention is exposed to circulating fluids of any kind.

Although the present invention has been shown and illustrated in terms of specific apparatus and techniques, changes and modifications can be made without departing from the spirit and scope of the invention as defined by the appended claims.

I claim:

1. Apparatus for simultaneously rotating and reciprocating well pipe, having an upper end, and mechanically utilizing a rotary table attached to a drilling rig, comprising:

a rotating pipe clamp assembly having an irregular cross-sectional mid-member and clamp members for releasably gripping said well pipe connected to the ends of said mid-member for rotation therewith, each of said clamp members having a body member with one end fittingly engaging the irregularity of cross-section of said mid-member, and a lock nut threaded to said body member, a sleeve grip member surrounded by said body member engagable with said well pipe, and a lock ring between said lock nut and said sleeve grip within said body member;

a square block for fitting to the rotary table square and having a selected grooved interior configuration;

a torque transmitting means fitted into said grooves having openings therethrough having the same irregular cross-section as said mid-member cross-section; and a torque limiting means connecting said torque transmitting means and said block for limiting torque applied through said well pipe via said clamp assembly and said torque transmitting means.

2. Apparatus as recited in claim 1 wherein said torque limiting means comprises said torque transmitting means having frictional hold means and shear pins releasably connecting said torque transmitting means and said block.

3. Apparatus as recited in claim 1 in which said mid-member comprises a splined section.

4. Apparatus as recited in claim 1 comprising a rotatable elevator having a thrust bearing engaging the upper end of said well pipe.

5. Apparatus for simultaneously rotating and reciprocating well pipe mechanically utilizing a rotary table attached to a drilling rig comprising:

a rotating pipe clamp assembly having an irregular cross-sectional mid-member and one or more clamp members for releasably gripping said well pipe connected to the ends of said mid-member for rotation therewith wherein each of said clamp members comprises a body member having one end fittingly engaging the irregularity of cross-section of said mid-member, and a lock nut threaded to said body member, a sleeve grip member surrounded by said body member engageable with said well pipe, and a lock ring between said lock nut and said sleeve grip within said body member;

a square block for fitting to the rotary table square and having a selected grooved interior configuration;

a torque transmitting means fitted into said grooves having openings therethrough having the same irregular cross-section as said mid-member cross-section; and a torque limiting means connecting said torque transmitting means and said block for limiting torque applied through said well pipe via said clamp assembly and said torque transmitting means.

* * * * *